US005377916A

United States Patent [19]

Anderson

[11] Patent Number: 5,377,916

[45] Date of Patent: Jan. 3, 1995

[54] SURFACE ABRASIVE TREATMENT OF SMALL OBJECTS

[75] Inventor: Alexander S. Anderson, Solihull, Great Britain

[73] Assignee: Koolmill Systems Limited, Solihull, Great Britain

[21] Appl. No.: 926,253

[22] PCT Filed: Feb. 12, 1990

[86] PCT No.: PCT/GB90/00222

§ 371 Date: Aug. 6, 1992

§ 102(e) Date: Aug. 6, 1992

[87] PCT Pub. No.: WO91/12078

PCT Pub. Date: Aug. 22, 1991

[51] Int. Cl.[6] ..... B02B 3/00

[52] U.S. Cl. ..... 241/7; 51/296; 426/483; 241/58; 241/79.1

[58] Field of Search ..... 51/273, 135 R, 62, 63, 51/DIG. 15, 137; 241/9, 58, 79.1, 7, 12, 13, 5; 426/483

[56] References Cited

U.S. PATENT DOCUMENTS

| | | | |
|---|---|---|---|
| 2,318,052 | 5/1943 | Bramble | 51/135 |
| 2,700,259 | 1/1955 | Dreyfus | 51/DIG. 15 |
| 3,862,345 | 1/1975 | Westover | 426/483 |
| 3,982,702 | 9/1976 | Barnhart | 241/58 |
| 4,229,486 | 10/1980 | Muller | 426/483 |
| 4,504,506 | 3/1985 | Vivier | 241/9 |
| 4,522,343 | 6/1985 | Williams | 341/58 |
| 4,747,550 | 5/1988 | Jackering | 241/58 |
| 5,097,636 | 3/1992 | Crouch | 51/273 |

FOREIGN PATENT DOCUMENTS

| | | | |
|---|---|---|---|
| 399155 | 11/1990 | European Pat. Off. | 51/135 R |
| 319342 | 1/1972 | U.S.S.R. | 426/483 |

*Primary Examiner*—Jack W. Lavinder

[57] ABSTRACT

An apparatus for use and a method of abrading small objects to remove surface material from such small objects, the apparatus including a chamber and an abrasive moving bottom that passes under a transverse wall of the chamber having an inlet and outlet for the abraded objects, recirculating the objects in the chamber and a lid for applying pressure on the recirculating objects to press them adjacent the bottom against the bottom; with the method comprising supplying the small objects to the chamber, recirculating the objects and applying pressure against the objects adjacent the bottom against the bottom against the bottom of the chamber and removing the abraded objects from the chamber outlet.

22 Claims, 2 Drawing Sheets

SURFACE ABRASIVE TREATMENT OF SMALL OBJECTS

The invention relates to apparatus and method for use in the surface abrasive treatment of small objects, for example, seeds, including cereals, legumes, nuts and the like; cleaning aggregate and objects of wood, plastics, mineral or metal.

Apparatus for this purpose is well known, but there is a long standing unsatisfied need for such apparatus which reliably removes and separates the surface material by abrasion without damaging the small objects or heating them to an unacceptable degree.

It is one object of this invention to satisfy this need.

According to one aspect of this invention there is provided apparatus for use in the abrasion of small objects to remove surface material therefrom, comprising: a chamber; means for providing an abrasive moving bottom which passes under a transverse wall of the chamber; an inlet for objects to be abraded, and an outlet for abraded objects, in use, objects recirculating in said chamber and material removed from said objects passing under the transverse wall, the chamber having a top, opposed to the bottom, the top being sufficiently close to the bottom that, in use, pressure is exerted on the recirculating objects to press the lowest objects against the bottom. The means for providing an abrasive moving bottom preferably includes an endless abrasive belt.

The apparatus preferably includes means for restricting the flow of abraded objects from the outlet.

Means are preferably included for drawing a vacuum outside the chamber, to remove material, abraded from the objects, from the means providing an abrasive moving bottom.

The invention also extends to a method of abrading small objects to remove surface material therefrom comprising; supplying objects to a chamber having a top and an abrasive moving which passes under a transverse wall of the chamber, so that objects recirculate in said chamber and material removed from said objects passes under the transverse wall; exerting pressure on the recirculating objects by means of the top to press the lowest objects against the bottom; and removing abraded objects from an outlet to the chamber.

One embodiment of the invention will now be described, by way of example only, with reference to the accompanying diagrammatic drawings, in which.

Figure 1:
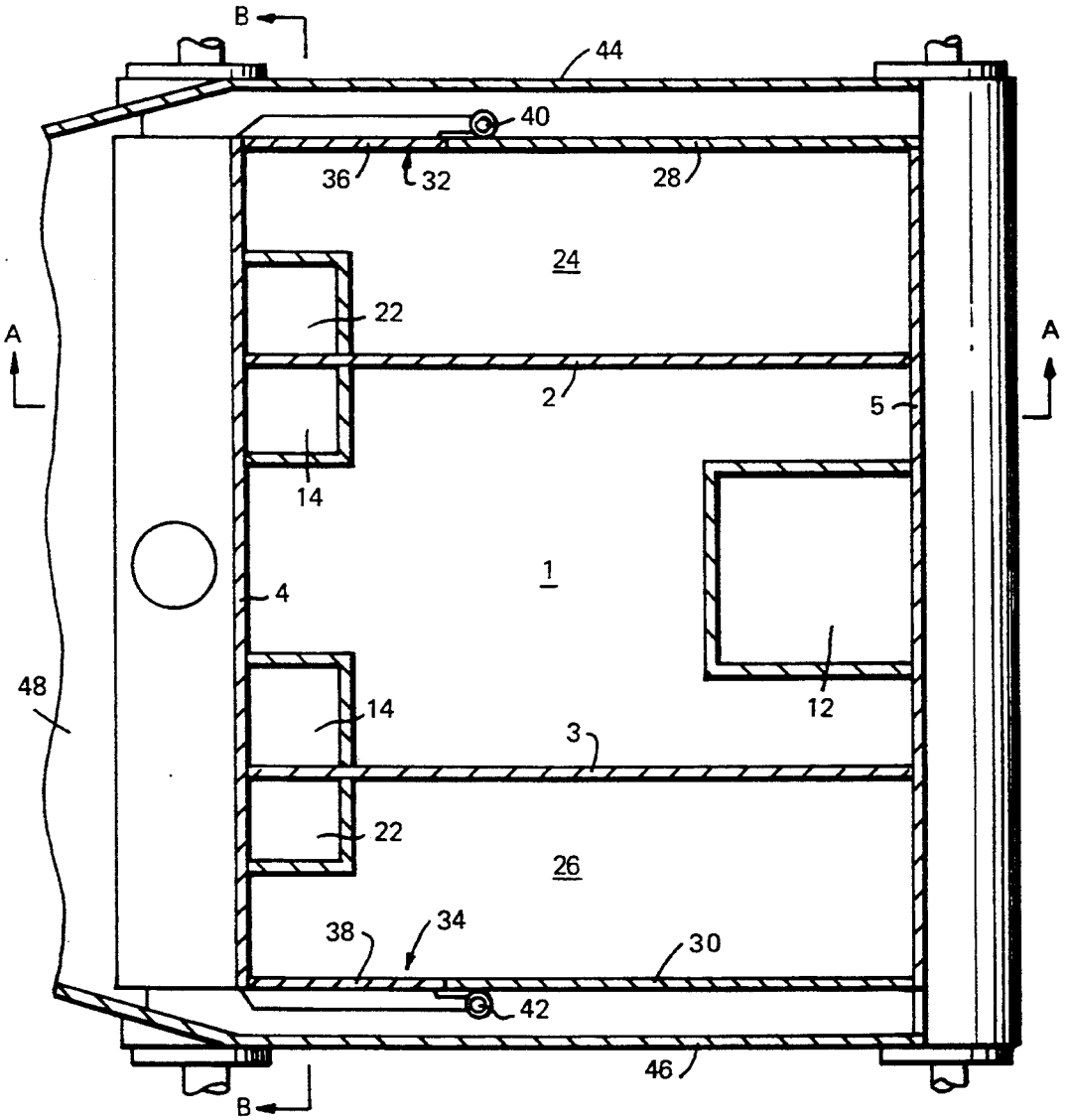
FIG. 1 is a plan, partly in section, of apparatus embodying the invention.

The apparatus shown in the drawing illustrates several features which may be utilised together or in the alternative.

A chamber is defined by a rectangular box 1 having elongate side walls 2, 3 and transverse walls 4, 5. A plate 6, defines the bedplate for an endless belt 7 which constitutes an abrasive moving bottom or floor of the chamber. The top or outer surface of the belt 7 has a coating of abrasive sand or grit. The belt passes underneath the end walls 4, 5 and the side walls 2 and 3 with a gap 8 in between. The gap between the transverse wall 4 and the belt 7 may be of the order of 0.254 mm (10 thousandths of an inch). The gaps between the other walls and the belt are not so critical but are preferably of the same order. A lid 11 is present on top of the side walls and end walls. An inlet pipe 12 extends from a hopper (not shown) into the chamber through the lid 11. An outlet is position adjacent the transverse wall to one side of a direct path from the inlet to the transverse wall.

In the present example, in the form of upwardly extending chutes 14, two outlets are spaced laterally from the inlet, one on each side thereof adjacent the transverse wall 4.

In use, small objects having a surface coating to be removed are loaded into the hopper and fed to the inlet 12. By way of example, the small objects may be grains of rice from which the outer layers, part or all of the bran layers, are to be removed. In this example, belt 7 is run at about 60 to 75 meters/min. Rice grains are fed via the inlet 12 into the chamber. The grains are transported by the moving belt 7 to the transverse wall 4 at the end of the chamber. The grains recirculate under the action of the belt, in the direction of the arrows, so that they contact the belt 7 repeatedly and an outer layer is removed.

Referring to FIG. 1, since the material removed passes under the wall 4 in a central portion of the belt and the grains leave the chamber at the edges of the belt, they may be collected separately, directed one from the other by baffles. In the example illustrated the baffles form a plenum chamber, adjacent the transverse wall 4. The plenum chamber defines a slot 18 adjacent to gap 8 between the transverse wall and the belt. A partial vacuum is drawn via the outlet 19 so that air is drawn in via the slot 18 removing material from the belt 7.

The gap 8 is sufficiently small, that only material which has been removed passes through. Thus in the case of polishing rice, any "fines" caused by grains breaking, will remain with the rice and not pass into the bran. In this way, the surface material is removed from and separated from the small objects. In practice the gap 8 is as small as possible preferably, 0.254 mm for example, (10 thousandths of an inch). The gap would not normally be larger than 0.762 mm (30 thousandths of an inch).

Because of the recirculation of the grains, they are well polished without breakage or being heated up.

Figure 2:
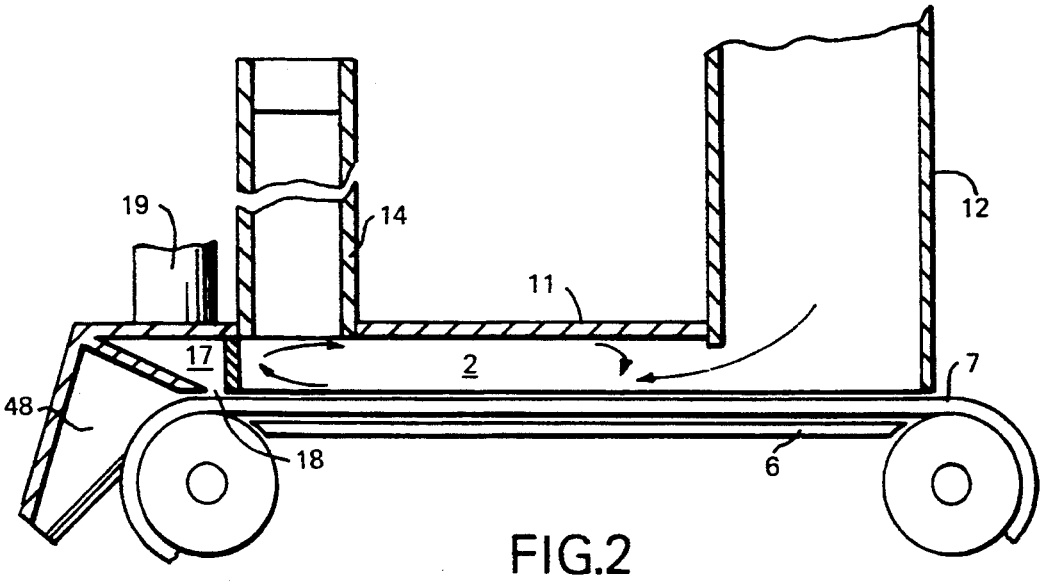
FIG. 2 is a longitudinal section on A—A of FIG. 1.

At the transverse wall 4, forward motion of the objects is arrested and they progress upwards and recirculate in the direction of the arrow in FIG. 2. The lid 11 is sufficiently close to the belt as to increase compaction of the objects to increase the pressure of the lower objects against the belt 7. The lid may be rigid or flexible, planar or shaped. A flexible lid may be subjected to pressure on its side exterior to the chamber, and thus act as a diaphragm.

In order to leave the chutes 14 the rice has to reach a predetermined height determined by the walls 20. This head of rice restricts the flow of rice from the outlets, increasing the pressure of the rice on the belt. The area of maximum pressure on the rice is found to be within an arc about 100 mm. centred on the corner between the side walls 2, 3 and the transverse wall 4.

The total width of the box 1 is thus about 150 mm.

In an alternative arrangement, the chutes may be replaced by a tubular outlet which rises to a predetermined (preferably adjustable) height before falling. The head of rice created by the rise functions to restrict the flow from the outlets.

The outlets 14 are illustrated adjacent the transverse wall 4 and the inlet 12 is illustrated remote from the wall 4. In alternative arrangements, the inlet and outlets may be in other positions as convenient. It may be desirable that if the outlets are downstream of the inlet (i.e. nearer the wall 4) they are not on a direct line from the inlet to the wall 4. In the arrangement illustrated the outlets 14 are situated one on either side of the inlet 12.

The height of the walls 20, over which rice must flow to leave the chute, controls the pressure of the rice against the belt. In some countries two grades of polished rice are produced: one for domestic consumption, having all or most of the bran removed; and another for export, having much less of the bran removed. To achieve these two degrees of polish the wall 20, or all the walls of the chute may be adjustable.

The arrangement described so far may stand alone and as such may polish rice at an improved rate with little heating thereof.

Preferably, in order to further improve output rate, a second stage is provided.

As illustrated the outlet chutes 14 feed directly into inlets 22 of second stage chambers 24, 26, the chamber 24 being formed between the walls 2, 4, 5 and a further outer wall 28 and the chamber 26 being formed between the walls, 3, 4, 5 and a further outer wall 30. As will be seen the inlet is adjacent the transverse wall 4. In another arrangement, the outlets from the chamber 1 are in the form of tubes which feed from a position adjacent the wall 4 to inlet positions at the back of the chambers 24, 26 near the inlet 12. These tubes rise to a predetermined height as discussed above.

Figure 3:
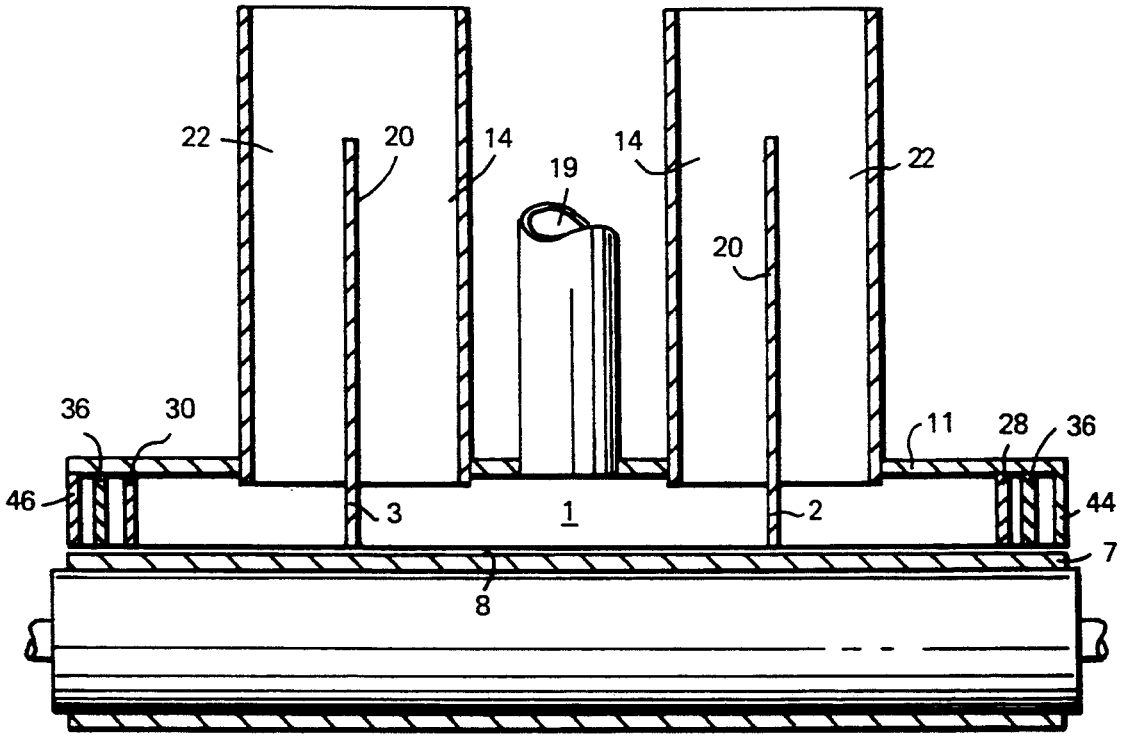
FIG. 3 is a section on B—B of FIG. 1.

Rice again recirculates in the chambers 24 and 26 and progresses across the belt to outlets 32 and 34 illustrated adjacent the transverse wall 4 and spaced laterally from the inlets 22 by being in the walls 28, 30. Means for restricting the flow of rice from the outlets 32, 34 are provided by closure members in the form of flaps 36, 38 which are pivotally mounted on pins 40, 42 so that they may close the outlets 32 and 34, as illustrated in FIG. 1, or may open the outlets as illustrated in FIG. 3. The flaps 36 and 38 are biased towards the closed position, for example, by pneumatic pressure (not illustrated) or by a system of weights and levers (not illustrated).

The force on the flaps 36, 38 affects the amount of work applied to the objects and thus the amount of material removed. Increasing the force on the flaps increases the amount of material which is removed. To this end the pneumatic pressure may be adjustable, as may be the weights.

In the case where the chambers 24, 26 are not provided, the outlet chutes 14 may be substituted by outlets 32 and closure members, e.g. in the form of flaps 36, 38. This substitution may also be made in the use of the two stage machine having the additional chambers 24 and 26, so that the outlets of the chamber, constitute inlets of the chambers 24, 26.

The outlets 32, 34 lead onto the belt. Rice leaving the outlets 32, 34 is confined to the belt by walls 44, 46 and guided thereby into a chute 48.

I claim:

1. Apparatus for use in abrasion of small objects to remove surface material therefrom, comprising a chamber; means for providing an abrasive moving bottom which passes under a transverse wall of the chamber; an inlet for objects to be abraded, and an outlet in said chamber for abraded objects, in use, objects recirculating in said chamber and material removed from said objects passing under the transverse wall, the chamber having a lid, opposed to the bottom, the lid being sufficiently close to the bottom that, in use, pressure is exerted on the recirculating objects to press the objects adjacent the bottom against the bottom.

2. Apparatus as claimed in claim 1, wherein the abrasive moving bottom is provided by an endless abrasive belt.

3. Apparatus as claimed in claim 1, wherein the outlet is spaced laterally across the belt from the inlet.

4. Apparatus as claimed in claim 1, wherein the outlet is in a sidewall of the chamber.

5. Apparatus as claimed in claim 1, wherein the outlet is adjacent the transverse wall.

6. Apparatus as claimed in claim 1, including two outlets, one on each side of the inlet.

7. Apparatus as claimed in claim 1, including means for restricting the flow of abraded objects from the outlet.

8. Apparatus as claimed in claim 7, wherein the means for restricting the flow of abraded objects comprises an upwardly extending chute or tube.

9. Apparatus as claimed in claim 8, wherein the height of the chute or tube is adjustable so as to adjust the decree to which flow is restricted.

10. Apparatus as claimed in claim 7, wherein the means for restricting the flow comprises a closure member which is biased closed against the outflow of abraded objects.

11. Apparatus as claimed in claim 10, wherein the bias is adjustable.

12. Apparatus as claimed in claim 1, including means for drawing a vacuum outside the chamber, to remove material, abraded from the objects, from the means providing an abrasive moving bottom.

13. Apparatus as claimed in claim 1, wherein the lid is a flexible diaphragm subject to pressure exterior to the chamber.

14. A method of abrading small objects to remove surface material therefrom comprising; supplying objects to a chamber having a lid and an abrasive moving bottom which passes under a transverse wall of the chamber; so that objects recirculate in said chamber and material removed from said objects passes under the transverse wall; exerting pressure on the recirculating objects by means of the lid, to press the objects adjacent the bottom against the bottom; and removing abraded objects from an outlet to the chamber.

15. A method as claimed in claim 14, wherein the chamber has an inlet and an outlet and a belt moving adjacent said inlet and outlet, and wherein the outlet is spaced laterally across the belt from the inlet.

16. A method as claimed in claim 14, including restricting flow of objects from the outlet.

17. A method as claimed in claim 14, including drawing a vacuum outside the chamber, to remove material abraded from the objects, from the means providing an abrasive moving bottom.

18. Apparatus for use in abrasion of small objects to remove surface material therefrom, comprising a chamber; means for providing an abrasive moving bottom which passes under a transverse wall of the chamber; an inlet for objects to be abraded, and an outlet for abraded objects, in use, objects recirculating in said chamber and surface material removed from said objects passing under the transverse wall, the chamber having a lid, opposed to the bottom, the lid being sufficiently close to the bottom that, in use, pressure is exerted on the recirculating objects to press the objects adjacent the bottom against the bottom, the apparatus including a plurality of said chambers arranged on a common bottom so that the outlet of one chamber constitutes or feeds on the inlet of another.

19. Apparatus as claimed in 18, including means for restricting the flow of abraded objects from the outlet.

20. Apparatus as claimed in claim 19, wherein the means for restricting the flow of abraded objects comprises an upwardly extending chute or tube.

21. Apparatus as claimed in claim 18, wherein the height of the chute or tube is adjustable so as to adjust the degree to which flow is restricted.

22. A method of abrading small objects to remove surface material therefrom comprising; supplying objects to a chamber having a lid and an abrasive moving bottom which passes under a transverse wall of the chamber; so that objects recirculate in said chamber and material removed from said objects passes under the transverse wall; exerting pressure on the recirculating objects; by means of the lid, to press the objects adjacent the bottom against the bottom; and removing abraded objects from an outlet to the chamber, including the step of restricting flow of objects from the outlet.

* * * * *